US005635662A

United States Patent [19]

Robertson et al.

[11] Patent Number: 5,635,662

[45] Date of Patent: Jun. 3, 1997

[54] METHOD AND APPARATUS FOR AVOIDING DETECTION BY A THREAT PROJECTILE

[75] Inventors: David B. Robertson, North Kingstown; Joseph J. Perruzzi, Tiverton; Laura C. Rabenold, Bristol, all of R.I.

[73] Assignee: The United States of America as represented by the Secretary of the Navy, Washington, D.C.

[21] Appl. No.: 605,314

[22] Filed: Feb. 7, 1996

[51] Int. Cl.[6] ..... G01S 3/80; G01S 5/18

[52] U.S. Cl. ..... 89/1.11; 364/517; 367/1; 367/97; 235/412; 235/413; 235/416

[58] Field of Search ..... 89/1.11; 235/411–416; 342/20; 367/1, 95–97; 364/517, 460–462, 923.4

[56] References Cited

U.S. PATENT DOCUMENTS

| | | | |
|---|---|---|---|
| 4,354,419 | 10/1982 | Patterson | 89/1.11 |
| 4,449,041 | 5/1984 | Girard | 235/412 |
| 4,848,208 | 7/1989 | Kosman | 89/1.11 |
| 4,961,174 | 10/1990 | Teel et al. | 367/97 |
| 5,107,271 | 4/1992 | White | 364/517 X |
| 5,153,366 | 10/1992 | Lucas | 89/1.11 |
| 5,233,541 | 8/1993 | Corwin et al. | 364/517 X |
| 5,267,329 | 11/1993 | Ulich et al. | 364/517 X |
| 5,581,490 | 12/1996 | Ferkinkoff et al. | 364/517 X |

*Primary Examiner*—Michael J. Carone
*Assistant Examiner*—Matthew J. Lattig
*Attorney, Agent, or Firm*—Michael J. McGowan; James M. Kasischke; Prithvi C. Lall

[57] ABSTRACT

A method and apparatus for use by a personnel in combat unit to assess in substantially real-time the threat to a combat unit posed by one or more threat projectiles. A command and control system receives a variety of input data and information signals and generates corresponding signals directed to a processing module. The processing module receives and processes the informational signals indicative of the status and characteristics of the combat unit and threat projectile. The processing module determines whether sample threat projectiles with an uncertainty region associated with each threat projectile detects the combat unit and determines therefrom a probability that the actual threat projectile detects the combat unit. The processing module also generates a probability of detection signals, to generate a report in user perceivable form, indicative of the probability of the threat projectile detecting the combat unit on a substantially real-time basis.

20 Claims, 6 Drawing Sheets

METHOD AND APPARATUS FOR AVOIDING DETECTION BY A THREAT PROJECTILE

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

This invention relates generally to the field of threat assessment and management in a three-dimensional battlefield environment and more specifically to a method and apparatus for assessing selected responses to a threat projectile.

(2) Description of the Prior Art

Methods and apparatus for sensing a threat projectile are known, as are methods and apparatus for providing appropriate counter attack measures. The following United States Letters Patent disclose examples of such devices:

U.S. Pat. No. 4,449,041 (1984) Girard

U.S. Pat. No. 4,848,208 (1989) Kosman

U.S. Pat. No. 5,107,271 (1992) White

U.S. Pat. No. 5,153,366 (1992) Lucas

Girard discloses a method for controlling antiaircraft fire upon detection of a threat airplane or other airborne device. Tracking data and antiaircraft trajectory data are continuously evaluated to determine the probability of a "hit". If the probability of the a hit falls below a predetermined level, the system initiates more fire. The probabilities of the two firings are then evaluated to arrive at a cumulative probability. If the cumulative probability of a "hit" is still below the set point, the system initiates additional antiaircraft fire. The process continues until the specified probability is met.

Kosman discloses an automated method for engaging multiple pursuer missiles with multiple targets. A computer secures tracking data and guidance data as inputs for a probabilistic method. The method enables engaging many individual targets with individual pursuer missiles and precludes the assessment of a plurality of individual pursuer missiles to an individual target.

White discloses a target track assessment scheme for use with multistation tracking of targets. The target track assessment scheme correlates each new track reported by a station with prior reported tracks to determine whether the new reported track corresponds to a new target or a previously reported target. This depends upon the position of the track and the tracking errors in the system.

Lucas discloses a battlefield method for allocating and assigning defensive weapons responsive to a weapons attack. The method includes estimating a threat value for each attack weapon, a threat value to the target and with respect to each defensive weapon, a counter threat value. Combining the threat and counter threat values in a predetermined relationship determines a series of prospective defensive weapons to reduce the effective threat value to the target to at least a predetermined level. The user then selects from the series of prospective defensive weapons to yield a particular counter effect to the attack weapons.

Thus, the foregoing patents describe devices and methods for assessing, tracking, and engaging either or both threat units and threat launch units. These systems attempt to achieve the reduction or minimization of threat to the combat unit or associated target by attacking the actual threat or the source of the threat to reduce future treats.

The prior art also includes an Advanced Weapons Management System (AWMS), a laboratory simulation used by the United States military, in particular the United States Navy. The AWMS acts as a testbed for the evaluation and testing of tactics and performances of various devices. The AWMS provides a computer simulated environment wherein the performance of a combat unit or device is modeled and tested against various threat and target environments. The AWMS quantitatively and graphically provides the results of such testing to provide a basis for assessment of tactical responses of combat units to threat units.

The AWMS system therefore provides an apparatus and method for assessing the maneuvers and counter measures employed by a combat unit against a threat projectile of the type to which this invention relates. The AWMS system is used for the evaluation of combat unit performance, for the purpose of selecting weapons systems and tactics for deployment in particular combat environments and for the purpose of analyzing unitary responses of a combat unit command structure in a simulated environment. However, to obtain statistical measures of effectiveness, AWMS must perform repeated simulations. The outcome of each simulation is completed before the next simulation is initialized. Thus, the AWMS is not designed to operate, and cannot be adapted to operate, in real-time. That is, it can provide neither information to the command structure of a combat. unit regarding the avoidance of a threat projectile nor a real-time simulation of a threat projectile attack on a combat unit that takes into account any defensive tactics employed by a user.

Thus, most of the foregoing references are generally focused on devices for enabling active interception of threat projectiles or sources of such projectiles. Others (e.g., the AWMS) provide a "test bed" for evaluation and analysis of maneuvers and counter measures of a combat unit to a threat projectile for the purpose of selecting appropriate combat units and analyzing tactical responses at a relatively leisurely rate. The references also fail to provide a simulator capable of providing a real-time analysis of tactical maneuvers responsive to a simulated attack by threat projectiles.

In three-dimensional combat environments, such as airborne and submarine warfare environments, evasion of threat projectiles provides a real and often preferred method of response to a threat projectile. In cases where the combat unit is a submarine, the threat projectile is generally a homing torpedo that enters a seek mode for detecting the submarine. Upon detection the torpedo enters a homing mode, travels to the target submarine and detonates. The safety and survival of a submarine and its crew, and thus its mission, depends in large measure on the tactical responses including maneuvers and the deployment of counter measures selected by the crew. If the submarine avoids detection, the submarine will usually survive the attack. Likewise in an airborne unit, such as a fighter aircraft, the corresponding tactical responses employed by the pilot are critical to avoid a threat missile and to survive the attack. In the past, the decisions employed by a crew of such a combat unit primarily have been based upon the crew's training and experience.

The foregoing references fail to provide apparatus for assessing, on a substantially real-time basis, the ability of a combat unit in a three-dimensional combat environment to avoid detection by a threat projectile. That is, these references fail to provide a real-time assessment of the survivability of the combat unit based upon the status of the threat projectile and the status of the combat unit. There is no provision for a tool by which the crew can determine whether a change of tactics is appropriate. The references do not disclose a simulator for providing a real-time assessment of the survivability of a combat unit based upon tactical responses of a command structure of such combat unit to a threat projectile attack. These references also do not disclose a corresponding training platform on which a crew can train to respond to an attack of a threat projectile.

SUMMARY OF THE INVENTION

It is therefore an object of this invention to provide a method and apparatus for assessing the survivability of a combat unit from a threat projectile in real or simulated three-dimensional combat environments.

It is another object of this invention to provide a method and apparatus for producing a set of optional tactical responses upon detection of a threat projectile that improves the likelihood of avoiding detection by the threat projectile in real or simulated three-dimensional combat environments.

It is still another object of this invention to provide an apparatus for evaluating tactical responses by a combat unit to evade the threat projectile in real or simulated three-dimensional combat environments and to enable essentially real-time evaluation of such responses.

It is yet another object of this invention to provide a method and an apparatus responsive to tracking information for enhancing a crew's decisions regarding the deployment of counter measures to avoid the threat projectile.

It is yet still another object of this invention to predict, on a substantially real-time basis, the probability of successful evasion for a tactical response by a combat unit so that the crew can elect alternate tactics.

It is a further object of this invention to provide a method and apparatus to provide a display indicating the probability of combat unit detection by a threat projectile.

In accordance with one aspect of this invention the threat to a combat unit in a three-dimensional combat environment posed by a homing projectile includes a command and control module generating a threat projectile signal, information signal and a combat unit information signals representing the position and status of a threat projectile and the position and status of a combat unit. A detection probability signal, generated by a processing module on a substantially real-time basis and responsive to the states of the first and second information signals, indicates a likelihood or probability of combat unit detection by the threat projectile.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF THE PREFERRED EMBODIMENT

Figure 1:
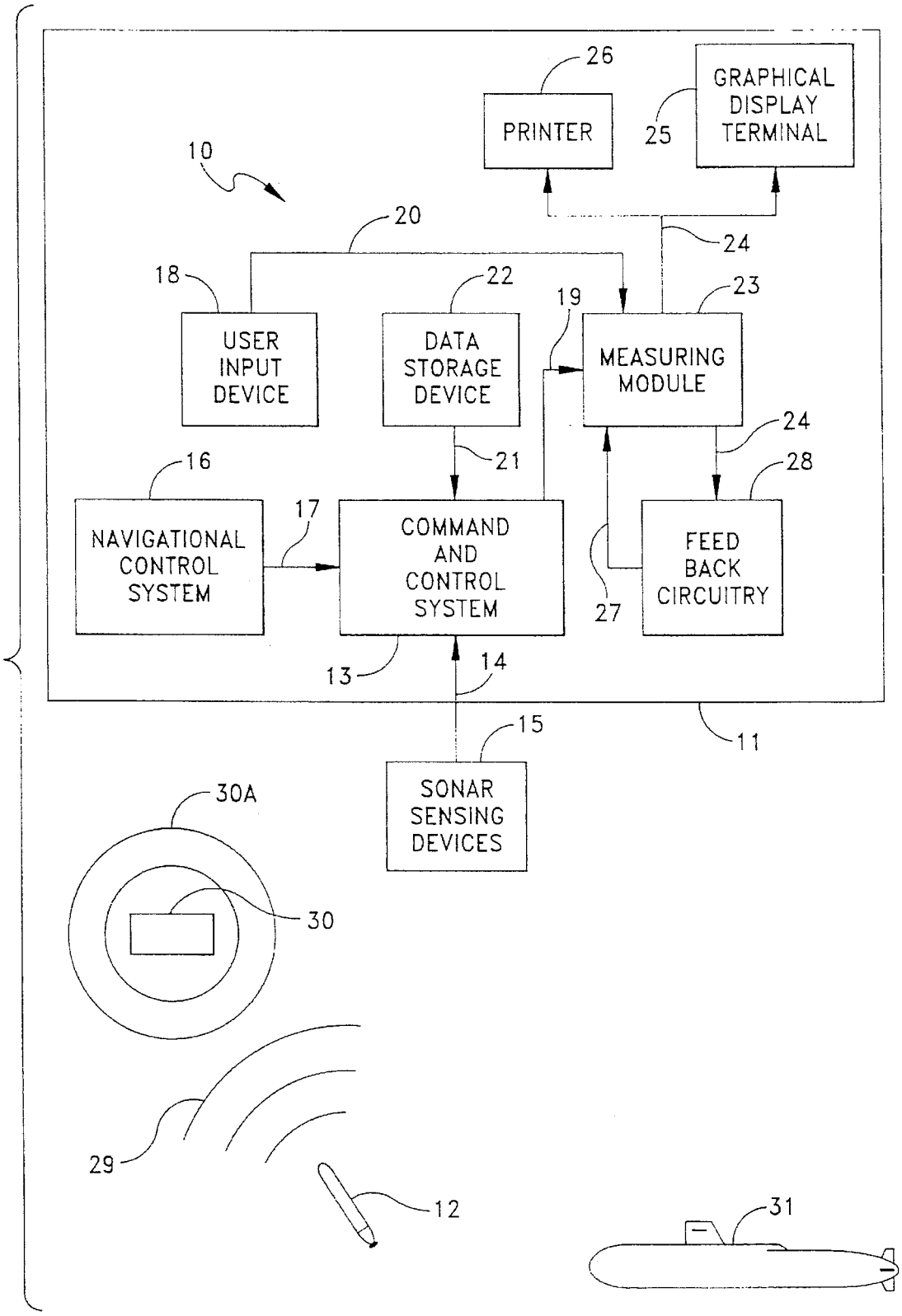
FIG. 1 is a diagram of a measuring device for assessing the threat to a combat unit posed by a threat projectile according to the present invention.

FIG. 1 diagrammatically illustrates assessment apparatus according to this invention for location in a combat unit 11, such as a submarine, for quantifying, in probabilistic terms, its survivability of an attack by one or more threat projectiles, such as torpedoes, in both real or simulated environments. The apparatus 10 includes a command and control system 13 with inputs 14 from sensors 15, such as sonar sensors in the case of a submarine, indicating the position and status of a threat projectile 12. A navigation control system 16 provides navigation signals 17 that convey conditions of the combat unit 11. A user input device 18, such as a keyboard, produces user input signals 20 responsive to user input information. Stored data signals 21 from a data storage unit 22 constitute database and formatting information that can include characteristics of the submarine or combat unit 11 and different torpedoes or threat projectiles 12.

Alternatively, apparatus according to this invention can operate as part of a simulator. In a simulator embodiment, other known simulator systems would provide the input signals 14 and navigation signals 17. Otherwise the apparatus would operate in substantially the same manner as described above. The similarities between the operation of the simulator and on-board apparatus will, as apparent, provide realistic training.

In either embodiment, a measuring module 23 responds to a command and control input signal 19 corresponding to signals 14, 17 and 21 and to user input signals 20 to determine, on a substantially real time basis, a probability that the combat unit 11 will successfully evade the threat projectile 12. The user input signal is directed to the command and control system 13 and optionally, to the measuring module 23. For purposes of this invention, successful evasion of the threat is defined as avoiding detection and damage by the threat projectile 12. The measuring module 23 generates detection probability signals 24 to provide a humanly perceptible report generally in graphical or textual format, such as an image on a graphical display terminal 25 or printed output on a printer 26. This report indicates the likelihood of avoiding detection by the threat projectile.

As will be appreciated in a real situation, and thus preferably in simulation, the signals 14 indicating the detection of a threat projectile do not provide exact resolution of the position and status of the threat projectile (e.g., range, bearing, speed, depth, etc). In accordance with this invention, it is assumed that the projectile 12 is anywhere within an uncertainty region 12A, shown in FIG. 2, and that its trajectory uncertainty range 12B is a function of the position and trajectory of the combat unit 11 as perceived by a launch platform 31. Thus, it can also be assumed that the projectile's perception of the combat unit 11 is subject to positional 11A and trajectory 11B uncertainties. Vectors 11C and 12C represent velocity vectors associated with the combat unit 11 and the threat projectile 12, respectively. Alternatively, the threat projectile's positional and trajectory uncertainties may be derived directly from the sensor inputs 14.

To resolve the uncertainties of the projectile position and trajectory, the measuring module 23 assumes a distribution of a user or pre-assigned number of "sample" projectiles within the region 12A and having a trajectory within the uncertainty range 12B. Typically the sampling population will be between 500 and 3000 samples. The form of the distribution is preassigned and is generally a linear or Gaussian or other suitable distribution that the measuring module 23 employs to assign the sample projectiles in the region 12A with corresponding trajectories 12B.

During each interval the measuring module 23 determines whether each sample projectile could have detected the combat unit 11 based, in part, on information from the storage device 22 concerning the characteristics of the threat projectile 12. Conditions effecting the propagation of emissions 29 from the threat projectile 12 are also considered by the measuring module 23 in determining detection. If the measuring module 23 determines that a sample projectile detects the combat unit 11, the measuring module 23 marks that sample projectile as having the opportunity of detecting the combat unit 11 and does not further analyze that sample projectile in subsequent intervals. The probability that the combat unit 11 is detected, $prob_d$, is calculated as:

$$Prob_D = \frac{T_D}{S_S} \quad (1)$$

where $T_D$ is the number of marked sample projectiles and $S_S$ is the sample size. Conversely, the probability of avoiding detection, $S_{urv}$, is:

$$S_{urv} = 1 - \frac{T_D}{S_S} \quad (2)$$

If personnel onboard the combat unit 11 monitor the value of "$S_{urv}$", as presented on the graphical display unit 25 or printer 26, they can alter the tactical response of the combat unit 11 to improve the survival probability. If such an alteration of tactics occurs, the measuring module 23 can be reset to initiate a new evaluation with different parameters, such as by varying the evasive maneuvers and/or tactics of the combat unit.

To simplify the further description of this invention, it is assumed that the combat unit 11 in FIG. 1 is a submarine; the threat projectile 12 is an acoustic homing torpedo that generates the emissions 29, which are acoustic waves in this case, when enabled; and the sensing devices 15 are sonar detecting devices such as hydrophones. In addition it is assumed that the submarine can deploy countermeasures 30, such as an active noise making device, for generating acoustic emissions 30A. The command and control system 13 generally can provide information about course depth and speed changes of the submarine, any deployed noise maker 30, and possibly the projectile 12 and its launching platform 31.

Figure 3A:
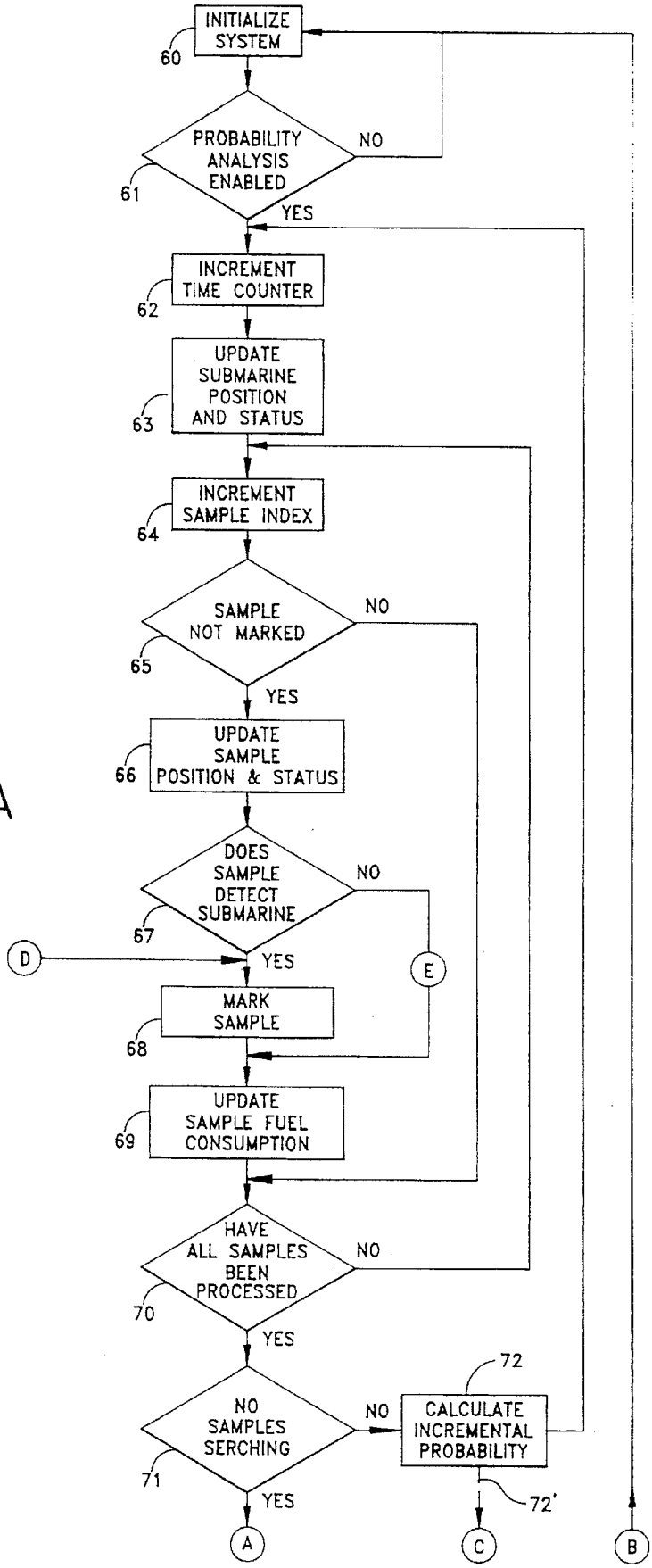
FIGS. 3A and 3B collectively are a flow chart graphically illustrating the operation of the embodiment of FIG. 1.
Figure 3B:
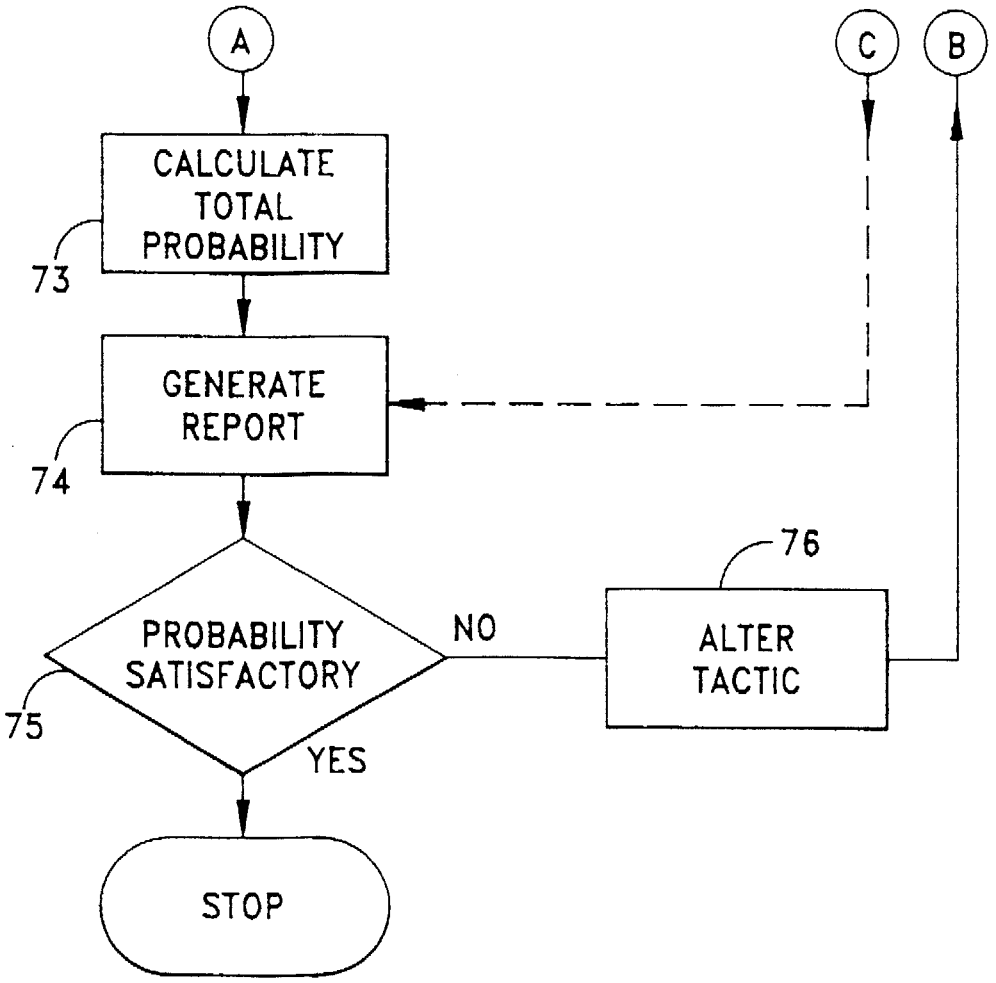

FIGS. 3A and 3B depict the operation of the apparatus in FIG. 1 beginning with an initializing step 60 to provide initial. inputs to the command and control system 13 from the database module 22 of FIG. 1. These inputs can represent a variety of "predetermined" tactical responses in the form of evasive tactics such as the following:

TABLE 1

| Index | Evasive Tactic |
|---|---|
| 1 | Turn away from the threat and accelerate to maximum speed |
| 2 | Deploy a first type of countermeasure, turn away from the threat, deploy a second type of countermeasure and accelerate to maximum speed |
| 3 | Turn away from the threat, deploy a first type of countermeasure and accelerate to maximum speed |
| 4 | Turn away from the threat, deploy a second type of countermeasure and accelerate to maximum speed |

Specific inputs could include the submarine turning rate and radii, acceleration characteristics and noise emanating from the submarine during such evasive tactics. Other inputs include characteristics of the torpedo including fuel conditions, the conditions under which the torpedo's homing apparatus activates and related information. The initialization step 60 could also include other database information relating to the torpedo launch platform 31. During step 60, the measuring module 23 (FIG. 1) also receives an update interval length (e.g., one interval every second) and a sample size (e.g., five hundred).

Figure 2:
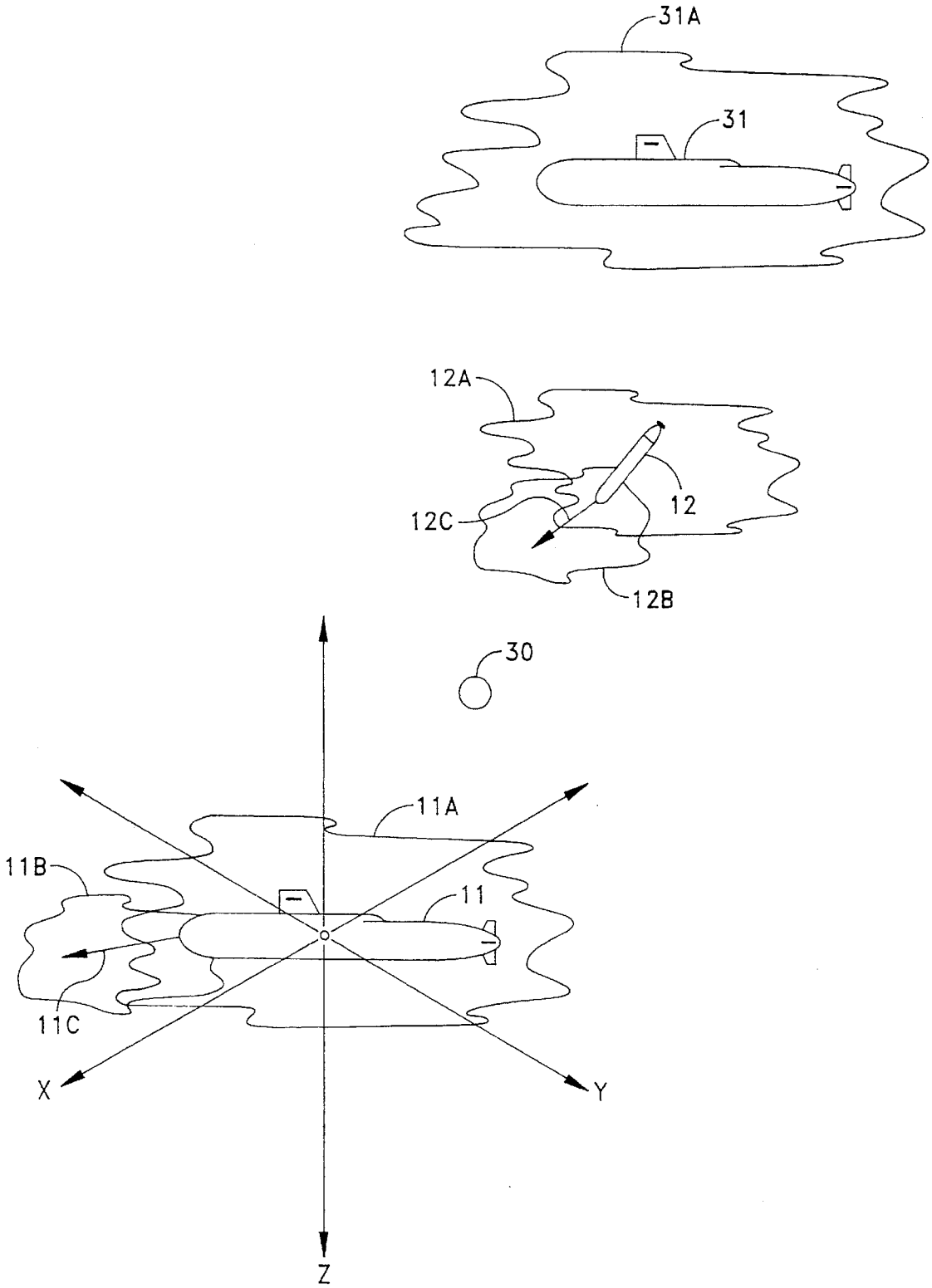
FIG. 2 a diagram of a combat unit, threat launch platform and a threat projectile in a three-dimensional combat space.

The measuring module 23 in FIG. 1 generally, as part of step in FIG. 3A, receives a probability model for assigning the uncertainty position regions 11A and 12A and the uncertainty trajectory ranges 11B and 12B of FIG. 2 according to an assessed solution quality of detected signals 29 from the sonar device 15. Such assessments could be qualitative in nature such as "good", "fair" or "poor". Alternatively, the uncertainty is associated with a particular detected signal 29 might be assigned based upon a Gaussian-distributed model, and other user assigned errordistribution model or other default value based system, such as the following:

TABLE 2

| Positional Information | GOOD | FAIR | Poor |
|---|---|---|---|
| RNG_ERR (Range Error in percentage) | 10–20 | 20–30 | 30–50 |
| BRG_ERR (Bearing Error in Degrees) | 0.5–2 | 2–4 | 4–8 |
| SPD_ERR (speed error in Knots) | 0–2 | 2–5 | 5–15 |
| CRS_ERR (course error in degrees) | 0–5 | 5–25 | 25–180 |
| DEP_ERR (depth error in feet) | 0–150 | 150–300 | 300–500 |

During step 60, each sample torpedo (e.g. 1 through 500) is assigned a series of "ping times" as a function of the torpedo's location and velocity. The assigned "ping times" (ptm) represent the moments at which the sample torpedo would transmit an acoustic signal in search of the submarine. Thus, each sample torpedo is assigned a position and status function that determines its location, speed, course, bearing and its "ping time" as a function of the sensed signal 29.

With continued reference to FIGS. 3A and 3B, the measuring module 23 of FIG. 1 waits after the initializing step 60 until personnel request an analysis in step 61. Once an analysis is requested, the measuring module 23 increments a time counter in step 62. In step 63 the measuring module 23 updates the position of the submarine 11. At step 64, the measuring module 23 increments a sample index corresponding to a sample torpedo and firing platform. A check to determine if the sample torpedo has been marked as detecting the submarine is performed in step 65. If the sampled torpedo is not marked, step 66 updates the sample torpedo's position and status based upon the updated position and status of the submarine 11. Then a procedure 67 determines if the sample torpedo detects the submarine and step 68 marks the sample torpedo as detecting the submarine, if appropriate. Step 69 updates the amount of fuel remaining in the sample torpedo directly following step 68, if a sample torpedo detects the submarine, or directly following step 67, if the sample does not detect the submarine. After step 69, the measuring module determines, in step 70, if all of the sample torpedoes have been processed.

If step 70 determines that all of the samples have not been processed, control returns to step 64. Otherwise, step 70 enables step 71 to determine if there is at least one sample torpedo that is still searching (i.e., not previously marked and not out of fuel). If no samples are determined to be searching, step 71 passes control to step 73 where the measuring module 23 calculates the total probability of survival and generates a report in step 74 indicating the total probability that the submarine 11 will avoid the threat projectile 12 on either the printer 26 or display terminal 25 of FIG. 1. If, at step 75, this probability is considered to be satisfactory, the program ends. Otherwise, the user may alter tactics/inputs in step 76 before step 60 is repeated. If, on the other hand, step 71 determines that sample torpedoes are still searching, control returns to step 62 after performing step 72 to calculate an incremental probability of survival.

Figure 4:
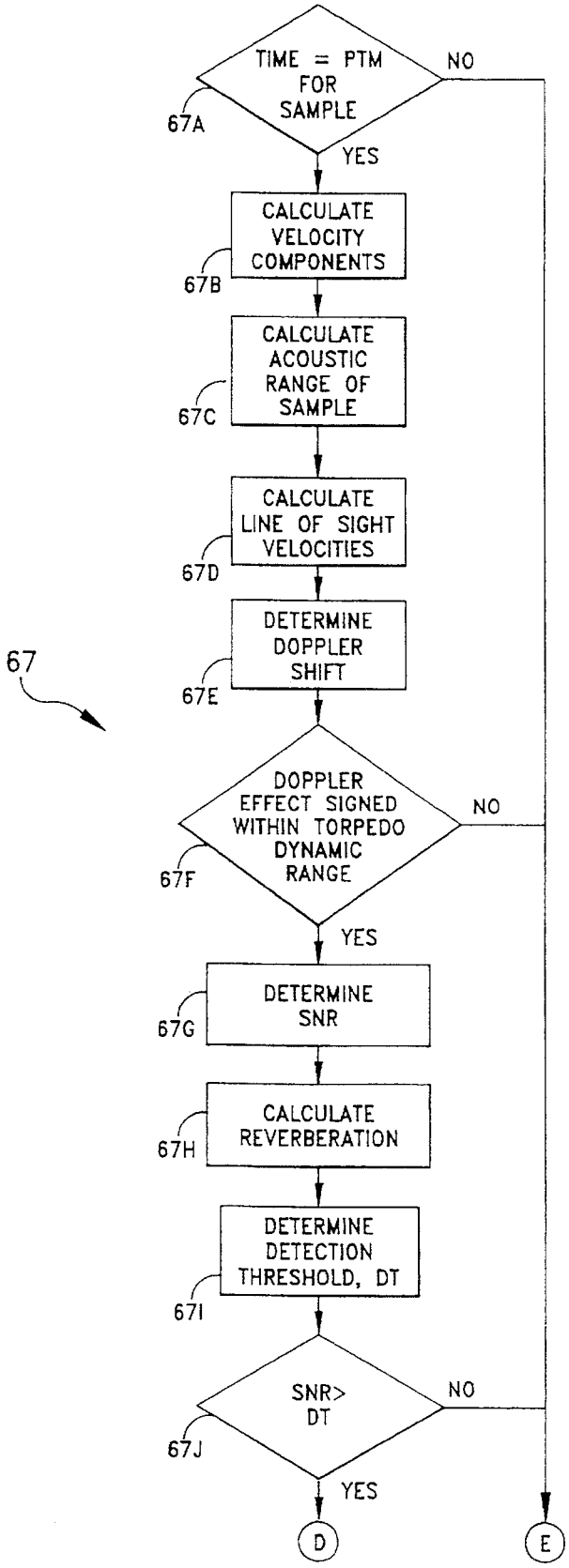
FIG. 4 is a portion of the flow chart of FIGS. 3A and 3B graphically illustrating in expanded form the steps of determining submarine detection by sample torpedoes.

Referring now to FIG. 4, procedure 67 includes a plurality of component steps 67A through 67J. The step 67A determines whether a particular sample torpedo has an assigned ping time (ptm) corresponding to the current time increment set by step 62 (FIG. 3A). In the event that an assigned ping time (ptm) of sample torpedo does correspond, the step 67A utilizes acoustic models to determine when the signal-to-noise ratio of a reflected ping for a particular sample torpedo exceeds a threshold level to indicate that the sample torpedo detects the submarine.

Figure 5:
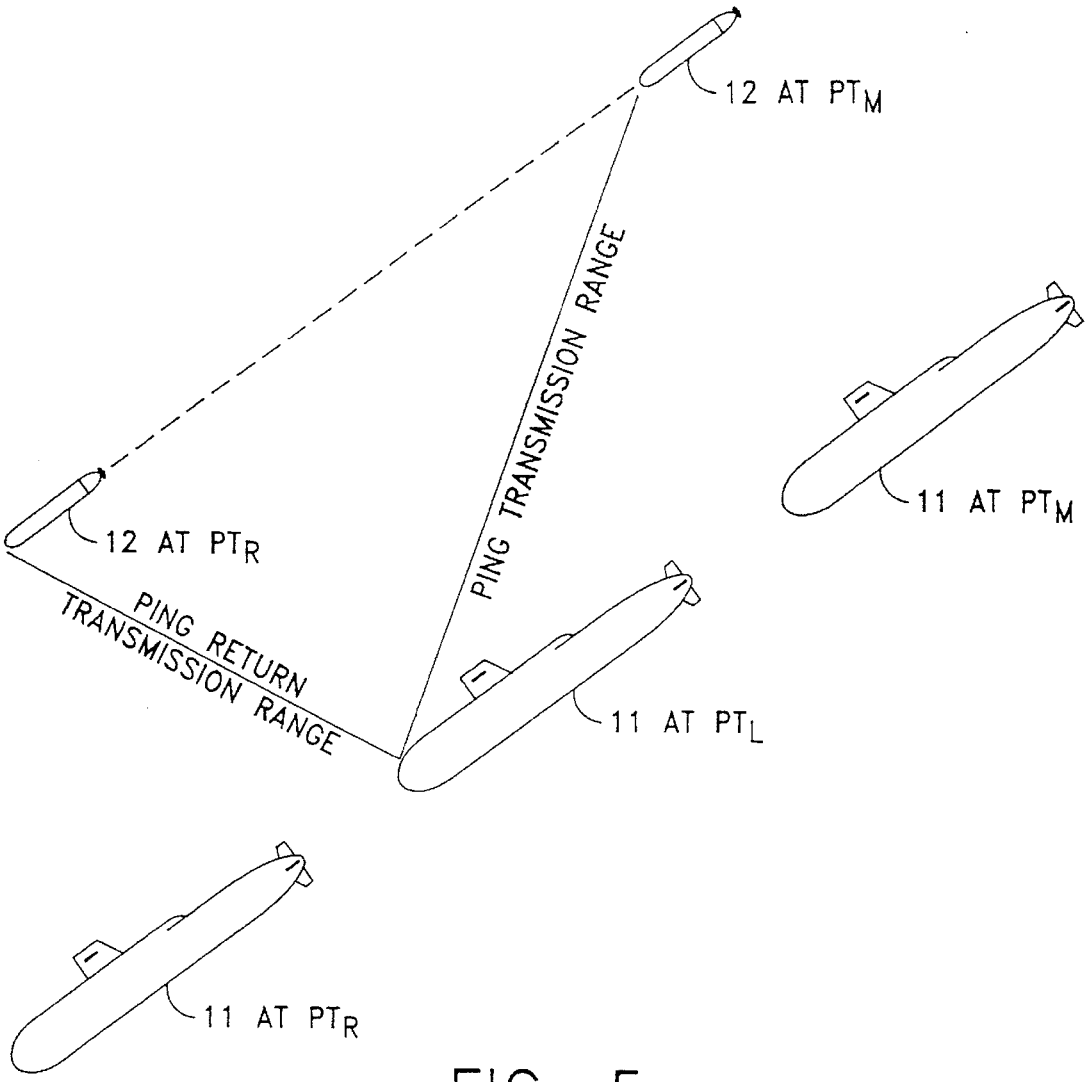
FIG. 5 illustrates the relationship between the position of a submarine and torpedo and a transmitted and reflected sonar signal.

This determination involves the calculation of (1) various factors such as the X, Y and Z-axis components of the velocities for each of the submarine 11 and the particular "pinging" sample torpedo 12, respectively, (2) the ping transmission range (i.e., the distance between the pinging torpedo 12 at the time of pinging ($PT_m$) and the submarine 11 at the time of incidence of the ping ($PT_L$)) and (3) the ping return transmission range (i.e., the distance between the submarine 11 at the time of incidence ($PT_L$) and the sample torpedo at the time of return of the reflected ping ($PT_R$), as graphically depicted in FIG. 5). These calculations are performed in step 67B and 67C of FIG. 4. Given. the positions of points of transmission and return and the velocities of the submarine and the sample torpedo, step 67D calculates line-of-sight velocities of the ping and reflected ping along the transmission path and the return path with respect to the torpedo (wlos_tr and wlos_rtn) and with respect to the submarine (olos_tr and olos_rtn).

With continuing reference to FIG. 4, step 67E uses these line of sight velocities to calculate a total Doppler shift for the frequency of the ping according to the following equation:

$$tot_dop = f_o - f_o\left(\frac{c_snd - olos_tr}{c_snd - wlos_tr}\right)\left(\frac{c_snd + wlos_rtn}{c_snd + olos_rtn}\right) \quad (3)$$

where the term "$f_o$" reports the transmitted frequency and the term "c_snd" represents the velocity of sound in sea water. The self Doppler component for the torpedo is determined by calculating the Doppler effect assuming that a stationary target were positioned in front of the sample torpedo by the following equation:

$$self_dop = -2f_o\left(\frac{tor_spd}{c_snd - tor_spd}\right) \quad (4)$$

The "tor_spd" term is the current speed of the sample torpedo during the particular interval. Subtracting the Doppler component "self_dop" component of equation (4) from the total Doppler shift of equation (3) yields a value representing the Doppler effect due to the submarine:

$$sub_dop = tot_dop - self_dop \quad (5)$$

The Doppler effect due to the submarine "sub_dop" is used to determine a frequency bin "$f_d$" that corresponds to the reflected sonar ping received by the sample torpedo. Step 67F compares the Doppler effect represented by equation (5) with the dynamic range of the torpedo model. If the resulting value of equation (5) does not fall within the dynamic range for the torpedo model, the particular sample torpedo is determined not to detect the submarine 11 during this time interval.

If, on the other hand, the frequency of the reflected sound is determined to be within the dynamic range of the torpedo, step 67G calculates a signal-to-noise ratio "SNR" for the reflected ping. Prior to the calculation of such signal-to-noise ratio, step 67G determines various components of the signal-to-noise ratio, including all applicable noise sources. Specifically, the device determines attenuation values for the outgoing and incoming ping signals "bpt" and "bpr", respectively. The attenuation represents the loss in signal strength due to the directivity of the respective beam patterns of the ping. The attenuation depends upon the angular separation of the incoming and outgoing wavefronts along the main and response axes of the transducer array.

Thus, the term "bpt" is calculated as a function of the transmit angles "xmit_ang" and "xmit_ver" that represent the horizontal and vertical angle components of the beam-front and, likewise, "bpr" is calculated as a function of the return angles "rtn_ang" and "rtn_ver". Step 67G calculates a transmit transmission loss "xmit_tl" based upon the transmission range between the position of the torpedo 12 and the submarine 11 at the time of transmission and incidence, respectively. A return transmission loss "rtn_tl" depending upon the range between the positions of the submarine 11 and the torpedo 12 at the time of incidence and return, respectively, is also calculated. The return transmission loss and the transmit transmission loss are each calculated by the following equation:

$$\text{transmission loss} = 20\log_{10}(rng) + (alp \times rng) \quad (6)$$

where the sound absorption coefficient "alp" represents the attenuation of sound waves in the water in decibels per yard. The transmission loss equation also assumes that the speed of sound along the range is constant. Thus, the only difference between the terms transmission loss "xmit_tl" and transmission loss "rtn_tl" is the difference in the ranges between the transmission of the signal to reflection from the submarine and from reflection to receipt at the torpedo.

Step 67G also calculates a background noise level "nt" at the sample torpedo transducer at the time the reflected signal is received according to the following equation:

$$nt = \log_{10}(10^{ntor} + 10^{ncmt} + 10^{nsub}) \quad (7)$$

where the term "ntor" represents the noise generated by the torpedo internally and by its motion through the water as a function of the bandwidth "bw" of the torpedo's transducer in decibels. In most cases the term "ntor" will be taken directly from the torpedo model data base according to the speed associated with the sample torpedo at the sample time interval. The terms "ncmt" and "nsub" represent the noise incident on the transducer of the torpedo 12 radiated by any noise making counter measures 27 deployed by the submarine 11 and by the submarine 11 itself, respectively.

The noise from the submarine is calculated by the equation:

$$nsub=(\text{noise}(sub)+bw)-(rtn_tl-bpr) \tag{8}$$

where radiated noise from the submarine "noise(sub)" is generally taken from the submarine model data base or other user input. The background noise attributed to the counter measures "ncmt" is calculated according to the following equation:

$$ncmt=\log_{10}\left(\sum_{i=1}^{n} 10^{ncm_n}\right), \tag{9}$$

where $$ncm_n=(cmn_n+bw)-(tl_n+Bpr_n) \tag{10}$$

In this case the term "$cmn_n$" is the radiated noise level from the. "nth" counter measure and the term "bw" is the same as in equation (6). The transmission loss "$Tl_n$" represents the reduction in effect of the sound generated by the noise maker to the torpedo transducer and is calculated using the equation (6) using the range between the noise maker and torpedo. Beam pattern loss "$Bpr_n$" is a function of the angle between the torpedo heading and the line of sight between the torpedo and counter measure (i.e., the horizontal and vertical angle components "cm_ang" and "cm_vert"). Thus, the total noise from the counter measure at the torpedo transducer includes a component comprising the summation of the noise from each of the counter measures. It is assumed in this instance that the counter measures are essentially stationary after deployment. Once the beam pattern attenuations "bpr" and "bpt", and the transmission loss for the transmission and reflectance of the ping are calculated, step 67G determines the signal-to-noise ratio "snr" according to:

$$snr=sl-bpt-xmit-tl+oss-rtn-tl-bpr-nt \tag{11}$$

where the term "sl" represents the source level of the transmitted ping along the main response axis of the transducer array of the torpedo. This value is generally supplied from the torpedo model data base supplied to the measuring module 21 from the storage device 14. The term "oss" represents the relative intensity of the ping reflected from the submarine is a ratio based upon (1) the aspect angle (i.e., the angle defined between the major axis of the submarine at the time of incidence of the ping signal and the line of sight from the torpedo at the time of the ping generation to the submarine at the time of incidence) and (2) the reflectivity of such ping upon incidence.

Step 67I calculates a detection threshold "dt" as a function of the detection frequency "$f_d$" and a calculated reverberation-to-noise ratio "rnr". The reverberation-to-noise ratio is found during step 67H by the following equation:

$$rnr=(rv-s)-nt \tag{12}$$

where the term "rv" represents the volume reverberation (of the reflected ping and the term "s" represents the receiver sensitivity generally supplied by the torpedo model data base indicating the voltage level resulting from a pressure wavefront incident on the transducer face. If during step 67J it is determined that the detection threshold "dt($f_d$,rnr)" is less than the signal-to-noise ratio "SNR", then the sample torpedo did not detect the submarine in this time interval and control passes to step 69 of FIG. 3A. Otherwise the submarine is considered detected and control passes to step 68 of FIG. 3A.

Referring now to FIGS. 3A and 3B, steps 72 and 73 used the following equation to calculate the probability of detection:

$$pdet=\frac{dsum}{\text{sample}} \tag{13}$$

where $$dsum=dcount+dsum \tag{14}$$

That is, the probability of detection "pdet" for the torpedo 12 is given by the total sample size (e.g., 500) divided into the total number of sampled torpedoes that detect the submarine by term "dsum". The term "dsum" is the number of sample torpedoes marked by step 68 which is the summation of the individual detections of all of the sampled torpedoes in the individual time intervals. The likelihood that the submarine will avoid the detection of several of the torpedoes, the probability of survival, "psur", is then determined by the measuring module according to the following equation:

$$psur=1-\frac{\sum_{w=1}^{nwp} dsum(w)}{nwp\times\text{sample}} \tag{15}$$

where the term "nwp" is the number of torpedoes in the three dimensional combat environment and dsum(w) is the total number of detecting sample torpedoes representing each torpedo.

The user interface device 18 of FIG. 1 preferably enables personnel of the combat unit to generate a report of the incremental probability determined by step 72 as indicated by the phantom line 72' between step 72 and step 74. Thus, in this case, the user can, if the incremental probabilities are unsatisfactory, alter tactics as in step 76 and enable another analysis.

It has been found that the probabilities of submarine avoidance of a torpedo as provided by the apparatus 10 are comparable with those predicted by the prior art AWMS system. In a particular comparison, a submarine was assumed to be heading 0° due north at a speed of ten knots (10 kt) and at a depth of six hundred feet (600 ft.). After detecting a threat torpedo, the submarine accelerated to maximum speed and with a heading 120° from the estimated bearing to the torpedo and deployed a counter measure. A comparison of the results for 10 different angles for each of three-different ranges, demonstrates that the present device provides substantially similar results to the AWMS system.

However, the present invention provides its results in substantially a real-time response. That is, in eleven representative simulated scenarios, the response time of the apparatus 10 was always at least two to three-times faster than the AWMS system, and in several instances the apparatus 10 was an order of magnitude faster.

An embodiment of this invention also has been used to analyze two simulated torpedoes with a torpedo sampling size of between 500 and 3000 for each simulated torpedo. This apparatus. operated with one-second sampling intervals to provide thereby a substantially real-time response to simulated data. These features thus enable the apparatus according to this invention to be used as an effective simulator and combat tool. Further, the apparatus 10 provides for the uncertainty in the position, speed and range of the torpedo whether in real or simulated environments to more accurately model the uncertainty of data in real environments. Thus, this apparatus constitutes a real-time device for use by the personnel of a combat unit as a tool to avoid detection in real combat environments and to assess and train command structure of a combat unit in simulated combat environments.

This invention has been disclosed in terms of certain embodiments. It will be apparent that many modifications can be made to the disclosed apparatus without departing from the invention. Therefore, it is the intent of the appended claims to cover all such variations and modifications as come within the true spirit and scope of this invention.

What is claimed is:

1. Apparatus for assessing in a three dimensional combat environment, a threat posed to a combat unit by a threat projectile of the type that seeks and upon detection homes on the combat unit, said apparatus comprising:

a command and control means for generating threat projectile positional and status information signals and combat unit positional and status information signals; and a measuring module means responsive to the threat projectile information signals and to the combat unit information signals generated by said command and control means for producing a substantially real-time detection probability signal indicating a likelihood of combat unit detection by the threat projectile.

2. An apparatus as recited in claim 1 wherein said measuring module means generates and analyzes a plurality of sample threat projectile signals responsive to the state of the generated threat projectile information signals in producing the detection probability signal.

3. An apparatus as recited in claim 1 further comprising a detection means connected to said command and control means for detecting a threat projectile in the three dimensional combat environment.

4. An apparatus as recited in claim 3 wherein the threat projectile is a torpedo, the combat unit is a submarine, and said detection means includes acoustic apparatus for detecting sonic emissions from the torpedo.

5. An apparatus as recited in claim 4 wherein said measuring module means generates and analyzes a plurality of sample torpedo signals responsive to the state of the generated torpedo information signals in producing the detection probability signal.

6. An apparatus as recited in claim 4 further comprising a navigation control means for controlling the position and status of the submarine, said navigation means being connected with said command and control means to enable said command and control means to produce positional and status informational signals.

7. An apparatus as recited in claim 6 further comprising a reporting means for generating a humanly perceptible transmission in response to the detection probability signal.

8. An apparatus as recited in claim 7 wherein said reporting means is a graphic display terminal.

9. An apparatus as recited in claim 8 wherein said command and control means generates information signals representing the position and status of a counter measure device and said measuring module means is also responsive to the counter measure information signals generated by said command and control means.

10. An apparatus as recited in claim 9 wherein said measuring module means generates and analyzes a plurality of sample torpedo signals responsive to the state of the generated torpedo information signals in producing the detection probability signal.

11. A method for assessing a threat posed by a threat projectile of the type which seeks, detects and then homes in on a combat unit in a three dimensional combat environment, said method comprising the steps of:

generating threat projectile information signals representing the position and status of a threat projectile in a three dimensional combat environment;

generating combat unit information signals representing the position and status of a combat unit in the three dimensional combat environment; and generating a substantially real time detection probability signal indicating the probability of combat unit detection by the threat projectile in response to the states of the threat projectile and combat unit information signals.

12. A method as recited in claim 11 wherein the combat unit is a submarine and the threat projectile is a homing torpedo and said step of determining includes assigning within an uncertainty region associated with the torpedo position and status a given plurality of sample torpedoes and calculating whether the sample torpedoes detect the submarine and said step of generating the detection probability signal includes calculating the probability for the detection of the submarine by the torpedo from the number of sample torpedoes calculated to detect the submarine and the given plurality of sample torpedoes.

13. A method as recited in claim 11 wherein said step of determining includes assigning within an uncertainty region associated with the threat projectile position and status a given plurality of sample threat projectiles and calculating whether the sample projectiles detect the combat unit and said step of generating the detection probability signal includes calculating the probability for the detection of the combat unit by the threat projectile from the number of sample threat projectiles calculated to detect the combat unit and the given plurality of sample threat projectiles.

14. A method as recited in claim 11 further comprising the step of providing a humanly perceivable representation of the probability of the combat unit detection by the threat projectile responsive to the generated detection probability signal.

15. A method as recited in claim 14 wherein the combat unit is a submarine and the threat projectile is a homing torpedo and said. step of generating the detection probability signal includes determining at a predetermined sampling rate whether the torpedo detects the submarine.

16. A method as recited in claim 15 wherein said step of determining includes assigning within an uncertainty region associated with the torpedo position and status a given plurality of sample torpedoes and calculating whether the sample torpedoes detect the submarine and said step of generating the detection probability signal includes calculating the probability for the detection of the submarine by the torpedo from the number of sample torpedoes calculated to detect the submarine and the given plurality of sample torpedoes.

17. A method as recited in claim 11 further comprising the step of generating counter measure information signals representing the position and status of a counter measure in the three dimensional combat environment wherein said step of generating the detection probability signal is also responsive to the state of the counter measure information signals.

18. A method as recited in claim 17 further comprises the step of providing a humanly perceivable representation of the probability of the combat unit detection by the threat projectile responsive to said generated detection probability signal.

19. A method as recited in claim 18 wherein the combat unit information signals represent a submarine and the threat projectile information signals represent a homing torpedo and said step of generating the detection probability signal includes determining at a predetermined sampling rate whether the torpedo detects the submarine.

20. A method as recited in claim 19 wherein said step of determining includes assigning within an uncertainty region associated with the torpedo position and status a given plurality of sample torpedoes and calculating whether the sample torpedoes detect the submarine and said step of generating the detection probability signal includes calculating the probability for the detection of the submarine by the torpedo from the calculated number of sample torpedoes detecting the submarine, and the given plurality of sample torpedoes.

* * * * *